US006734827B2

(12) United States Patent
Killen et al.

(10) Patent No.: US 6,734,827 B2
(45) Date of Patent: May 11, 2004

(54) HIGH EFFICIENCY PRINTED CIRCUIT LPDA

(75) Inventors: William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/185,275

(22) Filed: Jun. 27, 2002

(65) Prior Publication Data

US 2004/0001025 A1 Jan. 1, 2004

(51) Int. Cl.[7] ..... H01Q 11/10
(52) U.S. Cl. ..... 343/792.5
(58) Field of Search ..... 343/792.5

(56) References Cited

U.S. PATENT DOCUMENTS

| | | | | |
|---|---|---|---|---|
| 3,571,722 A | | 3/1971 | Vendelin | |
| 3,678,418 A | | 7/1972 | Woodward | |
| 4,495,505 A | | 1/1985 | Shields | |
| 4,525,720 A | | 6/1985 | Corzine et al. | |
| 4,800,344 A | | 1/1989 | Graham | |
| 4,825,220 A | | 4/1989 | Edward et al. | |
| 4,882,553 A | | 11/1989 | Davies et al. | |
| 4,916,410 A | | 4/1990 | Littlefield | |
| 4,924,236 A | | 5/1990 | Schuss et al. | |
| 5,039,891 A | | 8/1991 | Wen et al. | |
| 5,148,130 A | | 9/1992 | Dietrich | |
| 5,379,006 A | | 1/1995 | McCorkle | |
| 5,386,215 A | * | 1/1995 | Brown | 343/792.5 |
| 5,455,545 A | | 10/1995 | Garcia | |
| 5,523,728 A | | 6/1996 | McCorkle | |
| 5,541,613 A | * | 7/1996 | Lam et al. | 343/792.5 |
| 5,678,219 A | | 10/1997 | Agarwal et al. | |
| 5,900,844 A | | 5/1999 | Hill | |
| 6,052,039 A | | 4/2000 | Chiou et al. | |
| 6,094,176 A | * | 7/2000 | Van Hoozen et al. | 343/792.5 |
| 6,097,345 A | | 8/2000 | Walton | |
| 6,114,940 A | | 9/2000 | Kakinuma et al. | |
| 6,133,806 A | | 10/2000 | Sheen | |
| 6,137,376 A | | 10/2000 | Imbornone et al. | |
| 6,184,845 B1 | | 2/2001 | Leisten et al. | |
| 6,219,006 B1 | * | 4/2001 | Rudish | 343/792.5 |
| 6,239,761 B1 | | 5/2001 | Guo et al. | |
| 6,285,325 B1 | | 9/2001 | Nalbandian et al. | |
| 6,307,509 B1 | | 10/2001 | Krantz | |

OTHER PUBLICATIONS

Hong, Cheng–Shong, *Gain–Enhanced Broadband Microstrip Antenna, Proc. Natl. Sci. Counc. ROC(A)*, vol. 23, No. 5, 1999. pp. 609–611.

Nicolaidis, G.; Agboraw, E.; Vardaxoglou, Y., *A Minature Dielectric Loaded Antenna with Low SAR,* Navstar Systems, Ltd., Mansard Close, Northampton, UK.

U.S. patent application Ser. No. 10/448,973, Delgado et al., filed May 30, 2003.

U.S. patent application Ser. No. 10/184,277, Killen et al., filed Jun. 27, 2002.

U.S. patent application Ser. No. 10/185,443, Killen et al., filed Jun. 27, 2002.

U.S. patent application Ser. No. 10/184,332, Killen et al., filed Jun. 27, 2002.

(List continued on next page.)

*Primary Examiner*—Michael C. Wimer
(74) *Attorney, Agent, or Firm*—Sacco & Associates, PA

(57) ABSTRACT

A printed circuit log periodic dipole array (LPDA) includes dipole elements with arms having reduced size through use of high effective permittivity substrate portions. The radiation efficiency degradation generally associated with use of a high permittivitty substrate can be reduced through addition of magnetic particles to provide enhanced permeability in the high permittivity regions. The substrate preferably includes meta-materials. The feed line can provide a broadband transformation by being configured as a plurality of segments having quarter wave electrical lengths.

21 Claims, 8 Drawing Sheets

OTHER PUBLICATIONS

U.S. patent application Ser. No. 10/185,251, Parsche et al., Jun. 27, 2002.
U.S. patent application Ser. No. 10/185,847, Killen et al., filed Jun. 27, 2002.
U.S. patent application Ser. No. 10/185,273, Killen et al., filed Jun. 27, 2002.
U.S. patent application Ser. No. 10/308,500, Killen et al., filed Dec. 3, 2002.
U.S. patent application Ser. No. 10/373,935, Killen et al., filed Feb. 25, 2003.
U.S. patent application Ser. No. 10/404,285, Killen et al., filed Mar. 31, 2003.
U.S. patent application Ser. No. 10/404,981, Killen et al., filed Mar. 31, 2003.
U.S. patent application Ser. No. 10/404,960, Killen et al., filed Mar. 31, 2003.
U.S. patent application Ser. No. 10/185,144, Killen et al., filed Jun. 27, 2002.
U.S. patent application Ser. No. 10/185,266, Killen et al., filed Jun. 27, 2002.
U.S. patent application Ser. No. 10/185,162, Rumpf Jr., et al., filed Jun. 27, 2002.
U.S. patent application Ser. No. 10/185,824, Killen et al., filed Jun. 27, 2002.
U.S. patent application Ser. No. 10/185,187, Killen et al., filed Jun. 27, 2002.
U.S. patent application Ser. No. 10/185,855, Killen et al., filed Jun. 27, 2002.
U.S. patent application Ser. No. 10/185,459, Killen et al., filed Jun. 27, 2002.
U.S. patent application Ser. No. 10/185,480, Killen et al., Jun. 27, 2002.
U.S. patent application Ser. No. 10/439,094, Delgado et al., filed May 15, 2003

* cited by examiner

HIGH EFFICIENCY PRINTED CIRCUIT LPDA

BACKGROUND OF THE INVENTION

1. Statement of the Technical Field

The inventive arrangements relate generally to methods and apparatus for providing increased design flexibility for RF circuits, and more particularly for localized optimization of the properties of dielectric circuit board materials for improved log-periodic dipole array (LPDA) antenna performance.

2. Description of the Related Art

RF circuits, transmission lines and antenna elements are commonly manufactured on specially designed substrate boards. Conventional circuit board substrates are generally formed by processes such as casting or spray coating which generally result in uniform substrate physical properties, including the dielectric constant.

For the purposes RF circuits, it is generally important to maintain careful control over impedance characteristics. If the impedance of different parts of the circuit do not match, signal reflections and inefficient power transfer can result. Electrical length of transmission lines and radiators in these circuits can also be a critical design factor.

Two critical factors affecting circuit performance relate to the dielectric constant (sometimes referred to as the relative permittivity or $\epsilon_r$) and the loss tangent (sometimes referred to as the dissipation factor) of the dielectric substrate material. The relative permittivity determines the speed of the signal in the substrate material, and therefore the electrical length of transmission lines and other components disposed on the substrate. The loss tangent characterizes the amount of loss that occurs for signals traversing the substrate material. Accordingly, low loss materials become even more important with increasing frequency, particularly when designing receiver front ends and low noise amplifier circuits.

Printed transmission lines, passive circuits and radiating elements used in RF circuits are typically formed in one of three ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes.

Feed lines can also provide impedance transformations. For example, it is well known that a quarter-wavelength section of line can be designed to provide a match between a desired transmission line impedance and a given load impedance. For example, assuming the load and source impedances are substantially resistive, a transmission line can be matched to a load at the termination of the quarter-wave section if the characteristic impedance of the quarter wave section $$Z_{\frac{\lambda}{4}}$$

is selected using the equation:

$$Z_{\frac{\lambda}{4}} = \sqrt{Z_{01}Z_{02}}$$

where $$Z_{\frac{\lambda}{4}}$$

is the characteristic impedance of the quarter-wave section;

$Z_{01}$ is the characteristic impedance of the input transmission line; and $Z_{02}$ is the load impedance.

Simple quarter-wave transformers will operate most effectively only over a relatively narrow bandwidth where the length of the transformer approximates a quarter-wavelength at the frequency of interest. In order to provide matching over a broader range of frequencies, a multi-section transformer can be designed with a plurality of matching stages. For example, rather than attempting to use a single quarter-wave transmission line to transform from an impedance of 50 ohms to 10 ohms, one could use two quarter-wave sections in series. In that case, the first quarter wave section might be designed to transform from 50 ohms to 30 ohms, and the second quarter wave section might transform from 30 ohms to 10 ohms. Notably, the two quarter-wave sections when arranged in series would together comprise a half-wave section. However, this half wave section would advantageously function as a quarter-wave transformer section at half the design frequency. This technique can be used to achieve matching that is more broad-banded as compared to a simple quarter-wavelength section.

As the number of transformer stages is increased, the impedance change between sections becomes smaller. In fact, a transformer can be designed with essentially an infinite number of stages such that the result is a smooth, continuous variation in impedance Z(x) between feed line $Z_0$ and load $Z_L$. For maximally wide pass band response and a specified pass band ripple the taper profile can have an analytic form known as the Klopfenstein taper. There is substantial literature devoted to the design of multiple section and tapered transmission line transformers.

One problem with multiple transformer sections and tapered line transformers is that they are physically large structures. In fact, multiple section transformers are generally multi-quarter wavelengths long at the design frequency and tapered line transformers are generally at least about one wave-length long at the lowest design frequency and the minimum length is, to a degree, dependent on the impedance ratio. Accordingly, these designs are in many cases not compatible with the trend toward application of miniature semiconductors and integrated circuits.

Yet another problem with transmission line impedance transformers is the practical difficulties in implementation in microstrip or stripline constructions. For example, for a given dielectric substrate having a predetermined permittivity, the characteristic impedance of a transmission line is generally a function of the line width. Consequently, the width of the transformer section can become impractically narrow or wide depending on the transformation that a designer is trying to achieve, i.e., the impedance at each end of the transformer section.

In general, the characteristic impedance of a parallel plate transmission line, such as stripline or microstrip, is approximately equal to $\sqrt{L_l/C_l}$ where $L_l$ is the inductance per unit length and $C_l$ is the capacitance per unit length. The values of $L_l$ and $C_l$ are generally determined by the physical geometry and spacing of the line structure as well as the permittivity of the dielectric material(s) used to separate the transmission lines.

In conventional RF designs, a substrate material is selected that has a single relative permittivity value and a single relative permeability, the relative permeability value being about 1. Once the substrate material is selected, the line characteristic impedance value is generally exclusively set by controlling the geometry of the line.

The dielectric constant of the selected substrate material for a transmission line, passive RF device, or radiating element determines the physical wavelength of RF energy at a given frequency for that structure. One problem encountered when designing microelectronic RF circuitry is the selection of a dielectric board substrate material that is reasonably suitable for all of the various passive components, radiating elements and transmission line circuits to be formed on the board.

In particular, the geometry of certain circuit elements may be physically large or miniaturized due to the unique electrical or impedance characteristics required for such elements. For example, many circuit elements or tuned circuits may need to be an electrical ¼ wave. Similarly, the line widths required for exceptionally high or low characteristic impedance values can, in many instances, be too narrow or too wide for practical implementation for a given substrate. Since the physical size of the microstrip or stripline is inversely related to the relative permittivity of the dielectric material, the dimensions of a transmission line can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board substrate material with a high relative permittivity, such as 50 to 100. However, the use of a dielectric with a high relative permittivity will generally result in a significant reduction in the radiation efficiency of the antenna.

As with other components, an antenna design goal is frequently to effectively reduce the size of the antenna without too great a reduction in radiation efficiency. One method of reducing antena size is through capacitive loading, such as through use of a high dielectric constant substrate for the dipole array elements.

For example, if dipole arms are capacitively loaded by placing them on "high" dielectric constant board substrate portions, the dipole arms can be shortened relative to the arm lengths which would otherwise be needed using a lower dielectric constant substrate. This effect results because the electrical field in high dielectric substrate portion between the arm portion and the ground plane will be concentrated into a smaller dielectric substrate volume.

However, the radiation efficiency, being the frequency dependent ratio of the power radiated by the antenna to the total power supplied to the antenna, will be reduced primarily due to the shorter dipole arm length. A shorter arm length reduces the radiation resistance, which is approximately equal to the square of the arm length for a "short" (less the ½ wavelength) dipole antenna as shown below:

$$R_r = 20\,\pi^2\,(l/\lambda)^2$$

where l is the electrical length of the antenna line and λ is the wavelength of interest.

A conductive trace comprising a single short dipole can be modeled as an open transmission line having series connected radiation resistance, an inductor, a capacitor and a resistive ground loss. The radiation efficiency of such a dipole antenna system, assuming a single mode, can be approximated by the following equation:

$$E = \frac{R_r}{(R_r + X_L + X_C + R_L)}$$

Where

E is the efficiency $R_r$ is the radiation resistance $X_L$ is the inductive reactance $X_C$ is the capacitive reactance $X_L$ is the ohmic feed point ground losses and skin effect The radiation resistance is a fictitious resistance that accounts for energy radiated by the antenna. The inductive reactance represents the inductance of the conductive dipole lines, while the capacitor is the capacitance between the conductors. The other series connected components simply turn RF energy into heat, which reduces the radiation efficiency of the dipole.

An inherent problem with the conventional substrate approach is that, at least with respect to the dielectric substrate, the only control variable for line impedance is selection of a single relative permittivity. This limitation highlights an important problem with conventional substrate materials, i.e. they fail to take advantage of the other factor that determines characteristic impedance, namely $L_l$, the inductance per unit length of the transmission line. In addition, as noted above, conventional substrates do not provide the ability to vary the permittivity across the substrate area.

Yet another problem that is encountered in RF circuit design is the optimization of circuit components for operation on different RF frequency bands. Line impedances and lengths that are optimized for a first RF frequency band may provide inferior performance when used for other bands, either due to impedance variations and/or variations in electrical length. Such limitations can limit the effective operational frequency range for a given RF system.

Antenna elements are sometimes configured as antenna arrays, particular when broadband performance is desired. For example, a log-periodic dipole array (LPDA) represents a class of antennas in which a series of half-wavelength dipoles are arranged in a coplanar and parallel configuration on a transmission line. Such LPDAs are well known, and are in wide use.

The number of dipole elements used in the LPDA depends on the required performance characteristics. A metallic ground plane is generally located approximately one quarter-wavelength from each of the respective dipole elements.

An optimized LPDA would include a transmission line having feed line dimensions (length and width) that vary logarithmically along with the rest of the antenna dimensions, such as dipole length. Doing so, however, presents fabrication difficulties in realizing the required logarithmically varying dimensions. Thus, in practice, this form of the feed line is rarely seen because of fabrication difficulties.

Another shortcoming in conventional LPDAs also relates to the feed line. Feed lines are generally driven assuming they perform as microstrip lines having some impedance. To provide ¼ wave paths to ground for each dipole element, a non-planar structure is generally used, such as through use of a conically shaped ground plane. However, metal lines do not behave as microstrip lines as the distance from the feed line to the ground plane significantly increases. For example, excessive distances from ground can result as the feed line moves out from the feed point of an LPDA. Accordingly, conventional LPDA feed lines do not behave as a microstrip strip line beyond a small percentage (e.g. less than 30%) of the length of the feed line as measured from the feed point.

This non-ideal transmission line behavior can cause performance problems for the LPDA. The respective dipole elements of the LPDA are generally ideally spaced apart from one another such that a signal travelling along the transmission line flips about 180 degrees between dipole elements. However, since the feed line design can be substantially compromised, reasonable phasing of the respective elements in the LPDA may not be possible.

Accordingly, the use of conventional substrate boards which provide a single uniform dielectric material result in performance degradation for RF circuits in general, with LPDA based circuits suffering additional performance degrading effects. Attempts to reduce the size of such circuits generally result in further degradation of circuit performance.

SUMMARY OF THE INVENTION

A printed circuit log periodic dipole array (LPDA) antenna includes dipole elements with arms having reduced size through use of high effective permittivity substrate portions. The radiation efficiency degradation generally associated with use of a high permittivitty substrate can be be reduced through addition of magnetic particles to provide enhanced permeability in the high permittivity regions. The substrate preferably includes meta-materials.

The LPDA includes a dielectric circuit board substrate, the substrate having at least a first portion, the first portion providing at least one of a first relative permeability and a first relative permittivity. The first relative permeability and first relative permittivity are different from a bulk portion of the substrate. The LPDA is disposed on the substrate, the LPDA including at least one feed line and a plurality of dipole elements electrically connected to the feed line, wherein at least a portion of the dipole elements are disposed on the first portion.

The first relative permittivity can be at least 10. The first relative permeability can be at least 2, or from about 4 to 116. The first relative permeability is selected for increasing the radiation efficiency of the LPDA as compared to the radiation efficiency resulting from use of a first permeability of about 1. The first relative permeability is preferably approximately equal to the square root of the first relative permittivity.

At least a portion of the feed line is disposed on a second portion of the substrate, the second portion providing at least one of a second relative permeability and a second relative permittivity which are different from the bulk substrate. The feed line can have electrical width that increases substantially logarithmically outward from at least one feedpoint of the LPDA, even where the physical width of the feed line is non-substantially logarithmic, such as linear.

The second relative permittivity can be at least 10. The second relative permeability can be at least 2, or from about 4 to 116. The second relative permittivity and permeability can be different as compared to the first relative permittivity and permeability.

The feed line can function as a broadband impedance transformer. The broadband tranformer can include a plurality of segments. The plurality of segments can provide quarter wave electrical lengths, the respective electrical lengths determined at a highest frequency over which respective impedance transforms are to occur.

At least one of the second relative permittivity and second relative permeability can vary along a length of the feed line. In this embodiment, the characteristic impedance of the feed line can vary along its length in accordance with a tapered line type transformer. For example, the characteristic impedance of the feed line can be at least partially determined by a gradation of at least one the second relative permittivity and second relative permeability along a length of the feed line. The gradadation can continuously vary along at least a portion of the length of the feed line.

The LPDA can be a substantially planar array formed from a substrate having a substantially uniform thickness and including a substantially planar ground plane disposed beneath the substrate. The relative permittivity of the substrate beneath the feed line can increase the feed line moves out from a feed point of the LPDA. Thus, although the physical distance from the respective dipole elements to the ground plane is essentially the same for each dipole, the electrical distance is different. The relative permittivity increase can be linearly graded or increase in steps.

DETAILED DESCRIPTION OF THE PREFERRED EMBODIMENTS

Low dielectric constant board substrate materials are ordinarily selected for RF designs. For example, polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board substrate choices. The above board substrates are uniform across the board area in terms of thickness and physical properties and provide dielectric layers having relatively low dielectric constants with accompanying low loss tangents. The relative permeability of both of these substrate materials is nearly 1.

However, the use of conventional board materials can compromise the miniaturization of circuit elements and may also degrade some performance aspects of circuits that can benefit from high dielectric constant layers in discrete portions thereof. A typical tradeoff in a communications circuit is between the physical size of antenna elements versus efficiency. By comparison, the present invention provides the circuit designer with an added level of flexibility by permitting use of dielectric layer portions having selectively controlled permittivity and permeability properties which can permit the circuit to be optimized to improve the efficiency, functionality and physical profile of the antenna.

The invention provides the ability to locally vary the permittivity and permeability of the dielectric substrate, such as by including metamaterials in the substrate. Metamaterials refers to composite materials formed from the mixing of two or more different materials at a very fine level, such as the molecular or nanometer level. This can permit accomplishing certain design objectives for LPDAs without requiring changes be made to the physical dimensions of the feed line or the dipole elements. The invention may also be used together with varying physical dimensions to achieve futher enhanced design flexibility.

Figure 1:
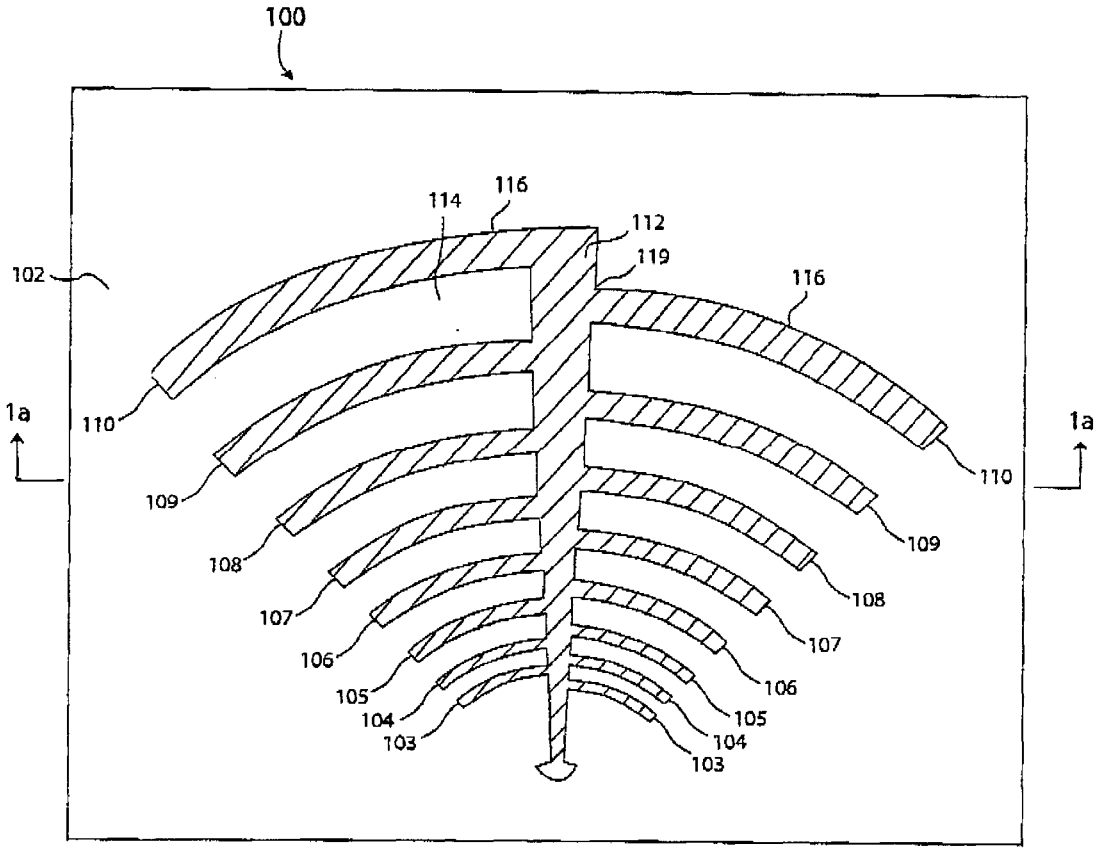
FIG. 1 is a top view of a log periodic antenna array (LPDA) antenna formed on a dielectric substrate for reducing the size and improving the radiation efficiency of the antenna.
Figure 1A:
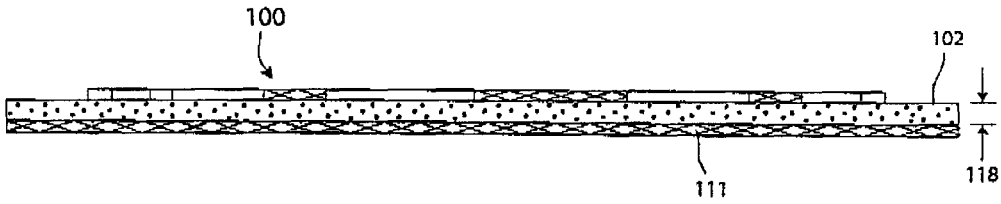
FIG. 1*a* is a cross-sectional view of the planar array in FIG. 1 taken along tine 1*a*—1*a*.

Referring to FIGS. 1 and 1*a*, cumulatively referred to herein as FIG. 1, an exemplary LPDA antenna 100 is shown. LPDA 100 comprises of eight (8) dipole elements 103–110 mounted on dielectric substrate 102. The dipole elements farther out from feed point 120 have a longer length and operate at a correspondingly lower resonant frequency as compared to dipole elements disposed closer to feed point 120.

An electrically conductive ground plane 111 is provided beneath LPDA 100. Ground plane 111 is substantially planar. Substrate 102 has a thickness 118 that defines a substantially constant physical antenna height above ground plane 111 for LPDA 100. Thus, LPDA 100 is a substantial planar array. The planar arrangement also improves the electrical function of the feed line structure as compared to conventional arrangements by permitting the feed line 112 to be brought closer to the ground plane 111, particularly at significant distances out from the feed point 120.

Planar LPDA 100 allows automated assembly as opposed to conventional LPDA-based antennas which must generally be hand built due to the need for a conical ground plane and hand mounting of dipole elements. Conical ground planes are generally formed by machine grinding. Planar LPDA 100 also provides a wide scan as compared to the bore sight scan provided by conventional LPDAs resulting from use of a conical ground plane.

The feed line shown in FIG. 1 is a microstrip line 112 which provides electrical connection to dipole elements 103–110. However, LPDA 100 can utilize other feed lines, such as twin-line or strip-line feeds.

Feed point 120 may be driven by a variety of sources via a suitable connector and interface, such as a coaxial connector (not shown). Although LPDA 100 is shown with 8 dipole elements, the invention is clearly not limited in this way.

Substrate 102 includes first portion 114 having a first set of dielectric properties including a first relative permittivity and a first relative permeability, and at least a second portion 116 having different dielectric properties as compared to first portion 114. Second portion includes a second relative permeability and a second relative permeability.

The first portion 114 can be a bulk substrate portion. The first relative permittivity is different from the second relative permittivity, preferably being lower. For example, the first relative permittivity can be about 3, while the second relative permittivity can be at least 10.

Dipole elements 103–110 are shown disposed over second portion 116. According to a preferred embodiment of the invention, the entire dipole element area of each dipole element 103–110 is disposed over second portion 116 as shown in FIG. 1.

Although second portion 116 provides a higher relative permittivity as compared to first portion 114, the second region need not, and in certain application preferably does not, provide a uniform permittivity value. For example, advantages can be derived for certain applications by providing substrate relative permittivities locally optimized for each dipole element 103–110.

Some conventional LPDAs use a planar dipole arrangement together with a non-planar (e.g. conical) ground plane in an attempt to provide ¼ wavelength paths to ground for each of the respective dipole elements. This non-planar arrangement is required because each dipole operates over a different frequency range and the substrate between the dipole elements and ground generally provides uniform characteristics (e.g. air).

In a preferred embodiment of the invention, the permittivity for respective dipole elements 103–110 in second portion 116 are independently customized to provide quarter wavelength electrical paths to ground plane 111 at their respective operating frequencies. The ¼ wave (or other desired) condition can be provided for each dipole element 103–110 with the planar arrangement shown in FIG. 1 by providing increasing permittivity in second portion 116 customized for each respective dipole to achieve the ¼ wave (or other desired) condition as the dipole distance (and corresponding operating frequency) from feed point 120 increases.

Higher second relative permittivity values also permit a reduction in the physical size of dipole elements 103–110. As noted earlier, the relative permittivity in second portion 116 can be substantially larger values as compared to the first relative permittivity in first portion 114. In general, resonant length is roughly proportional to $1/\sqrt{\epsilon_r}$ where $\epsilon_r$ is the relative permittivity of the substrate. Accordingly, selection of a higher value of relative permittivity can be used to reduce the physical dimensions of the traces comprising dipole elements 103–110.

One problem with increasing the second relative permittivity in second substrate portion 116 beneath dipole elements 103–110 is that radiation efficiency of LPDA 100 may be reduced as a result. Microstrip antennas printed on high dielectric constant and relatively thick substrates tend to exhibit poor radiation efficiency. With substrates providing higher values of relative permittivity, a larger amount of the electromagnetic field is concentrated in the dielectric substrate between the conductive antenna element and the ground plane. Poor radiation efficiency under such circumstances is often attributed in part to surface wave modes propagating along the air/substrate interface.

The present invention permits formation of board substrates also having one or more regions having significant permeability. As used herein, significant permeability refers to a relative permeability of at least about 2. Prior substrates generally included materials having relative permeabilities of approximately 1. The ability to selectively add significant permeability to portions of the dielectric substrate can be used to increase the inductance of nearby conductive traces, such as transmission lines and antenna elements. This flexibility can be used to improve RF system performance in a number of ways.

For example, in the case of short dipole antennas, dielectric substrate portions having significant relative permeability can be used to increase the inductance of the dipole elements to compensate for losses in radiation efficiency from the use of a high relative permittivity (e.g. 50 to 100) dielectric substrate portions. Accordingly, resonance can be obtained, or approached, at a desired frequency by use of a substrate region having a relative magnetic permeability larger than 1. Thus, the invention can be used to improve performance or obviate the need to add a discrete inductor to the system in an attempt to accomplish the same function.

In general it has been found that as relative substrate permittivity increases beyond about 4, it is desirable to also increase the substrate permeability in order for the antenna to better match, and as a result, more effectively transfer electromagnetic energy from the microstrip dipole structure into free space. For greater radiation efficiency, it has been found that the relative permeability can be increased roughly in accordance with the square root of the local relative permittivity value. For example, if a substrate provided a second relative permittivity of 9, a good starting point for the second relative permeability would be 3. Of course, those skilled in the art will recognize that the optimal values in any particular case will be dependent upon a variety of factors including the precise nature of the dielectric structure above and below the antenna elements, the dielectric and conductive structure surrounding the antenna elements, the height of the antenna above the ground plane, width of the dipole arm, and so on. Accordingly, a suitable combination of optimum values for permittivity and permeability can be determined experimentally and/or with computer modeling.

Those skilled in the art will recognize that the foregoing technique is not limited to use with dipole-based antenna, such as the LPDA antenna 100. Instead, the foregoing technique can be used to produce efficient antenna elements and arrays of reduced size in other types of substrate structures. For example, rather than residing exclusively on top of the substrate as shown in FIG. 1, the antenna elements 103–110 can be partially or entirely embedded within the second portion 116 of substrate 102.

FIG. 1 shows microstrip feed line 112 being disposed over third portion 11. Third region provides a relative permittivity greater than first substrate portion 114. Third portion 119 can have dielectric different as compared compared to second portion 116. This arrangement permits the size of the feed line to be reduced as compared to when a lower permittivity dielectric is used. However, the use of a high relative permittivity in third potion 119 can result in reduced impedance of the feed line 112.

The invention provides the ability to offset reductions in impedance due to the use of higher permittivity substrates, by raising line inductance through diposing an adjacent dielectric portion having a substantial relative permeability. Accordingly, the invention allows the addition of magnetic particles sufficient to allow the effective magnetic permeability of the dielectric between the lines in the case of twin-line and the line and the ground plane in the case of a microstrip feed to be optimized based on the effective dielectric permittivity between the lines for twin-line or between the line and the ground plane for a microstrip feed.

The invention allows effectively increasing the feed line line width through dielectric changes alone. For example, the dielectric constant can be raised to decrease impedance without changing the the physical width of the feedline.

The invention can be used to optimize other aspects of LPDA design. Although an LPDA is known to be ideally optimized with a logarithimically varying feed line width, conventional techniques can at best generally only provide a linear taper increasing outward from the feed point. The invention can provide customizable dielectric and optional permeability properties which can be used to substantially realize an ideal feed line for LPDA which expands logarithmically along its length, to match the dipole geometries. For example, a linear (or other) physical non-logarithmic taper can function as an electrical logarithmic taper through appropriate dielectric selection. In certain applications, it may also be possible to produce an electrical logarithmic taper using a constant physical line width throughout.

The combination of a logarithmic line taper and a constant short physical separation between the respective dipole elements and the ground plane allows optimization of the electrical function of the line. This combination largely overcomes the design compromises imposed in conventional LPDA designs when using a substrate which provides uniform dielectric properties for the design of an antenna that operates over a wide bandwidth. When the optimized feed line is applied to the LPDA, overall performance of the LPDA can be optimized because each dipole can be independently optimized. For example, individual dipole element performance can be improved through better impedance matching of the feed line impedance to the respective dipoles through localized manipulation of substrate permittivity and/or permeability.

In certain applications, it may be desired have the feed line 112 not only have a reduced size, but also provide a broadband transformation of impedance for impedance matching, such as matching the driving source impedance to the impedance of each of the respective dipole elements. For example, feed line 112 can provide a broadband transformation of impedance which can be used for improved impedance matching between a transceiver network with the dipole elements comprising LPDA 100.

In the case of a microstrip feed, the optimized broadband impedance transformation can be realized through manipulation of the relative permittivity and/or the relative permeability of the substrate between feed line 112 and ground plane 111. In the case of a twin-line feed, the relevant substrate portions may also include the substrate portion disposed between the respective lines.

Figure 2:
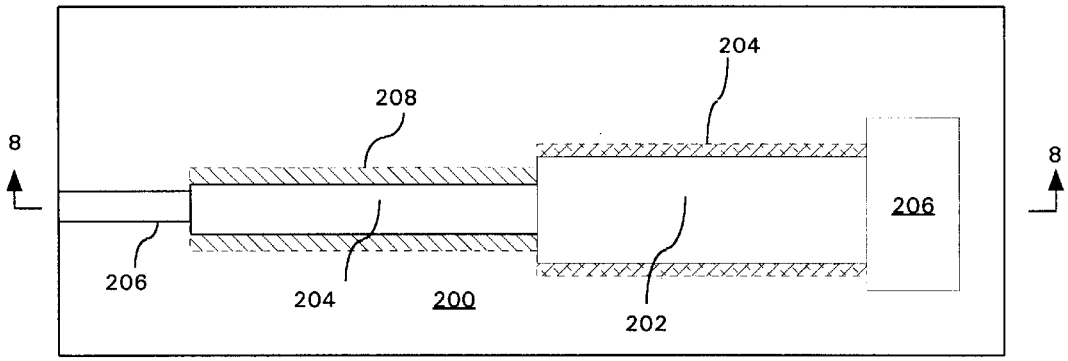
FIG. 2 is a top view of a feed line configured as multi-section impedance transformer.
Figure 2A:
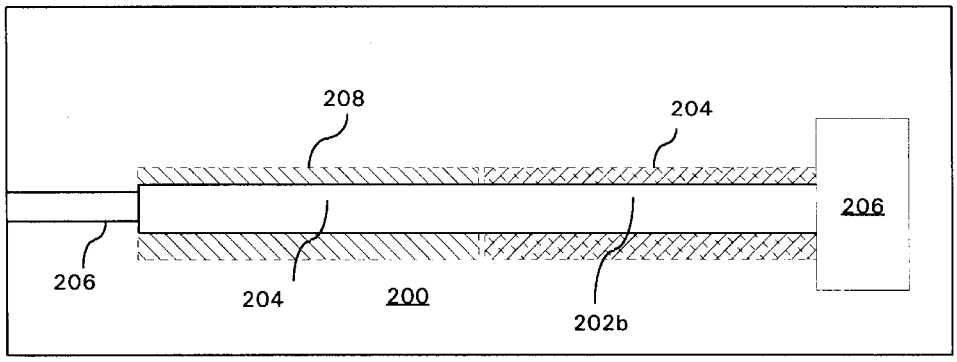
FIG. 2*a* is a top view of an alternative embodiment of the multi-section impedance transformer in FIG. 2.
Figure 3:
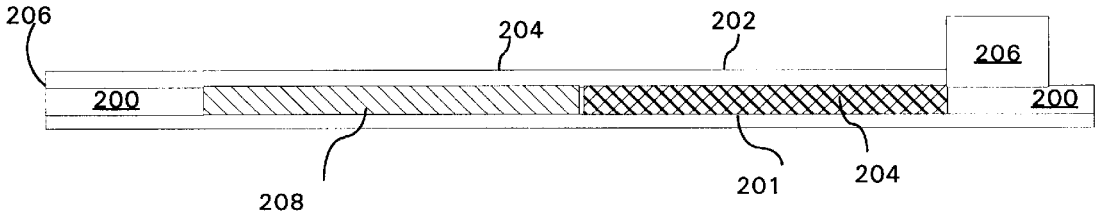
FIG. 3 is a cross-sectional view of FIG. 2 taken along line 8—8.

The broadband feed line transformer can be provided from a multi-section feed line structure. FIGS. 2 and 3 show a feed line configured as a multi-section transformer in which a wide range impedance transformation can be practically achieved over a broader bandwidth than would otherwise be possible with only a single transformer section.

Section 204 provides a microstrip implementation of a quarter-wave transformer on a substrate 200. A ground plane 201 is provided beneath the substrate as shown. Substrate region 208 that is beneath the transformer section 204 has substrate characteristics that are different from the remainder of the substrate 200 that is coupled to the input and output transmission line sections 202, 206 respectively. For example, the permittivity in region 204 can be selectively increased so as to reduce the physical length of the quarter-wave transformer section 204.

A second quarter-wave transformer section 202 is provided to provide greater operating bandwidth for the transformer. It should be understood, however, that the two transformer sections are merely by way of example and the concepts disclosed herein can be extended to transformers having a greater number of sections.

The permittivity and permeability of the substrate in regions 208 and 204 can have electrical properties that can be different as compared to each other and with regard to the remainder of the substrate. Accordingly, a designer is provided with substantially greater flexibility with regard to the range of characteristic impedances that can be produced on the substrate 200. Permeability can be increased in regions 208 and/or 204 for achieving practical implementation of transformer sections with higher characteristic impedance than would otherwise be possible on the substrate 200. Permittivity can be increased in regions 208 and/or 204 for achieving practical implementation of transformer sections with lower characteristic impedance than would otherwise be possible on the substrate 200.

In FIGS. 2 and 3, quarter-wave transformer sections 204 and 202 are shown having different widths. It should be noted however that the widths of the transformer sections could be held constant, and the characteristic impedance of each section in that case could be controlled exclusively by selection of the characteristics of the substrate regions 208 and 204 beneath the respective quarter-wave transformer sections. This alternative embodiment is illustrated in FIG. 2(*a*) which shows transformer section 202*b* as having a line width equal to section 204.

The foregoing approach is not limited to use with microstrip constructions as shown in FIGS. 2 and 3. Rather, it can be used with any other feed line structure that is formed on a dielectric substrate circuit board. For example, these same techniques can be used for buried microstrip and stripline circuits where selected regions of the dielectric above or below the transmission line have modified permittivity or permeability. Moreover, these techniques are particularly useful in the case of twin line structures such as that shown in FIGS. 4 and 5.

Figure 4:
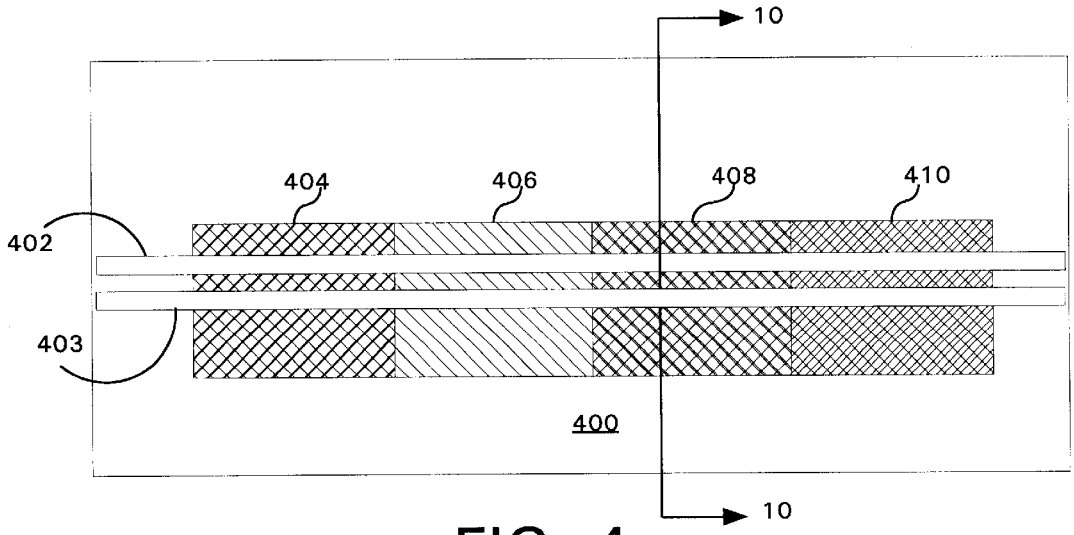
FIG. 4 is a cross-sectional view of a twin-line feed line configured as a multi-section impedance transformer.
Figure 5:
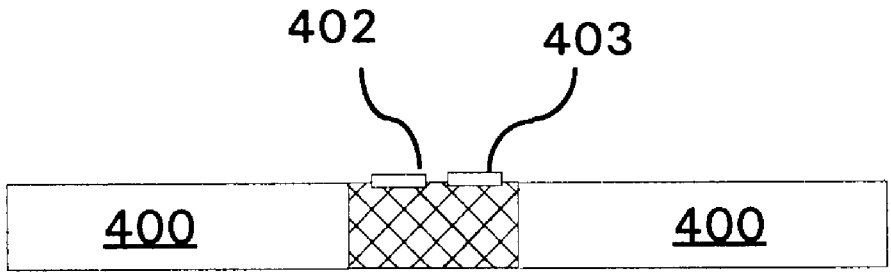
FIG. 5 is a cross-sectional view of the multi-section impedance transformer in FIG. 4 taken along lines 10—10.

FIGS. 4 and 5 show a multiple section transformer formed from a twin line structure disposed on a substrate 400. The twin line structure is composed of a pair of elongated conductors 402, 403 on disposed in spaced apart relation on the same side of the substrate that together function as a transmission line. The characteristic impedance of the transmission line in FIGS. 4 and 5 is determined by a variety of factors, including the coupling between the elongated conductors 402, 403. The coupling can be affected by the spacing between the lines as well as the characteristics of the substrate proximate to the lines.

Substrate regions 404, 406, 408, 410 can be sized in quarter-wave steps at a selected design frequency. Consequently the portions of lines 402, 403 disposed on these substrate regions will define quarter-wave transformer sections, with the characteristic impedance of each section determined by the characteristics of the substrate.

According to a preferred embodiment, the permittivity and/or permeability characteristics of the substrate in each of regions 404, 406, 408, 410 can be chosen independently to achieve a desired line impedance for a particular transformer section. By independently controlling these dielectric properties for each region in this way, a wider range of characteristic line impedances can be practically achieved without the need for altering the thickness of the substrate board 400. For example, increasing the permittivity in a region 404, 406, 408, 410 can permit lines of lower impedance as compared to what could otherwise be achieved using conventional low permittivity substrate. Conversely, increasing the permeability in one or more of these regions can permit lines of higher impedance than that which would otherwise be practically possible on a substrate that is merely a compromise design selection.

Figure 6:
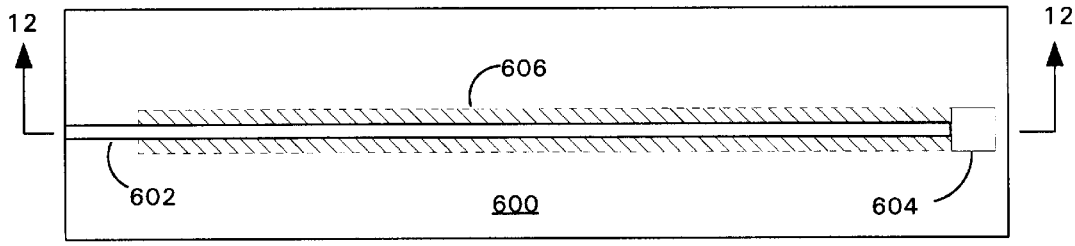
FIG. 6 is a top view of a feed line configured as an impedance transformer formed on a substrate region, the substrate region having varying substrate characteristics.
Figure 7:
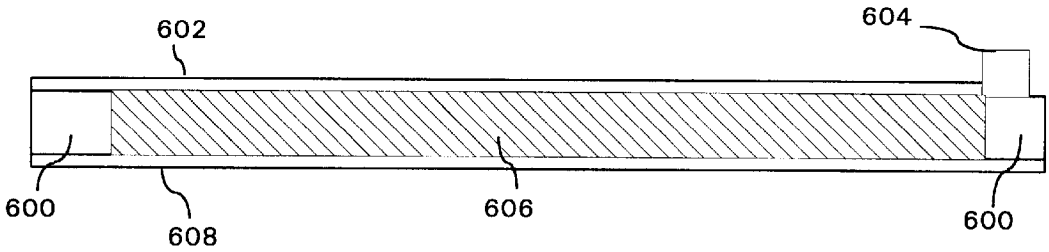
FIG. 7 is a cross-sectional view of the impedance transformer in FIG. 6 taken along lines 12—12.

The impedance transformer shown in FIGS. 6 and 7 is based on the concept of a conventional tapered line transformer. Basic techniques for designing the overall length and impedance characteristics for tapered line transformers are well know among those skilled in the art. The device in FIGS. 6 and 7 includes a microstrip transmission line 602 formed on a substrate 600. In this case, the transformer is being used to match into dipole elements of an LPDA, depicted as reference 604. The transmission line 602 can be of constant width as shown, or can have a width that varies somewhat over its length. A ground plane 608 is provided beneath the substrate 600 so as to form a microstrip structure.

Unlike conventional tapered line transformers, the feed line configuration in FIGS. 6 and 7 does not necessarily vary the line impedance by continuously increasing the line width over the length of the transformer. Instead, the effective permittivity and/or effective permeability can be varied continuously or in a series of small steps within substrate region 606 so as to gradually change the characteristic impedance over the length of the line 602.

For example, the substrate in region 606 can have a permeability of 1 and a permittivity of 10 at a first end, and a permeability of 10 and a permittivity of 1 at an opposing end. The actual values and precise rate at which each of these substrate characteristics can be varied over the length of the substrate region 606 will depend upon the particular design characteristics of the transformer and the range of impedance characteristics sought to be obtained. These precise values for the permittivity and permeability within each part of region 606 can be determined experimentally or through the use of computer modeling.

Figure 8:
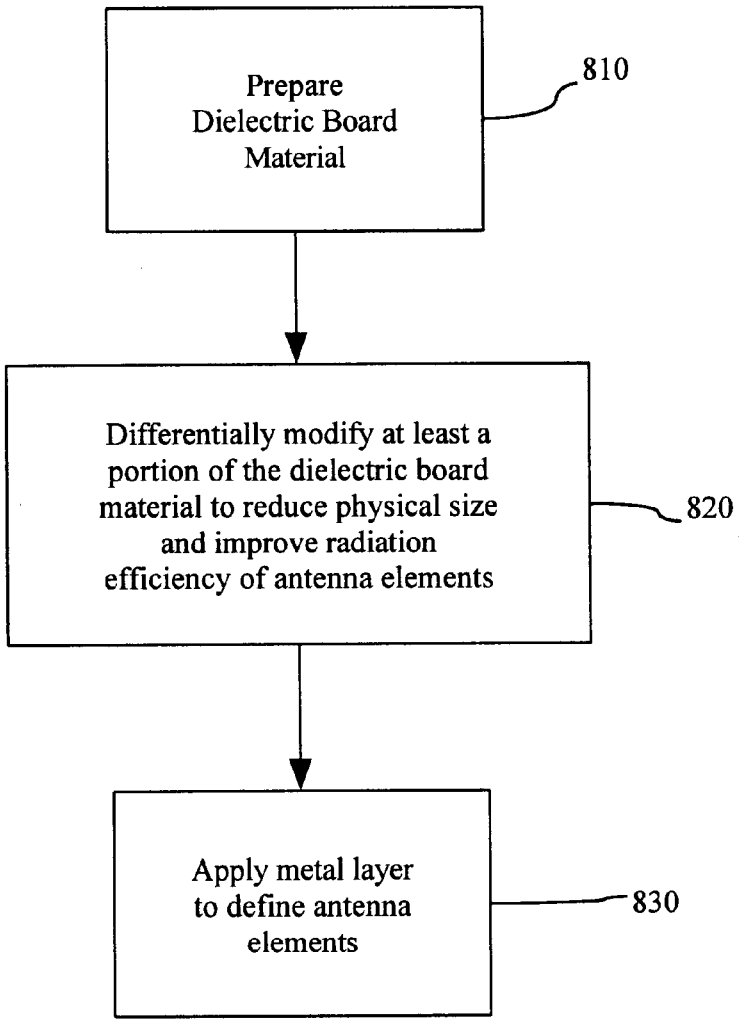
FIG. 8 is a flow chart that is useful for illustrating a process for manufacturing an antenna of reduced physical size and high radiation efficiency.

Dielectric substrate boards having metamaterial portions providing localized and selectable magnetic and dielectric properties can be prepared as shown in FIG. 8. In step 810, the dielectric board material can be prepared. In step 820, at least a portion of the dielectric board material can be differentially modified using metamaterials, as described below, to reduce the physical size and achieve the best possible efficiency for the antenna elements and associated feed circuitry. Finally, a metal layer can be applied to define the conductive traces associated with the antenna elements and associated feed circuitry.

As defined herein, the term "metamaterials" refers to composite materials formed from the mixing or arrangement of two or more different materials at a very fine level, such as the Angstrom or nanometer level. Metamaterials allow tailoring of electromagnetic properties of the composite, which can be defined by effective electromagnetic parameters comprising effective electrical permittivity (or dielectric constant) and the effective magnetic permeability.

The process for preparing and differentially modifying the dielectric board material as described in steps 810 and 820 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28–30 Ultra Low Fire COG dielectric formulation. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include metamaterials. The choice of a metamaterial composition can provide tunable effective dielectric constants over a relatively continuous range from less than 2 to about 2650. Tunable magnetic properties are also available from certain metamaterials. For example, through choice of suitable materials the relative effective magnetic permeability generally can range from about 4 to 116 for most practical RF applications. However, the relative effective magnetic permeability can be as low as about 2 or reach into the thousands.

The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions. For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant. The dielectric material added as a supplemental layer can include various polymeric materials.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating. Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate (LiNbO3), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic as used herein, a magnetic particle refers to particle which provides a paramagnetic or ferromagnetic response to an externally applied magnetic field. For example, magnetic properties may be tailored with organofunctionality. The impact on dielectric constant from adding magnetic materials generally results in an increase in the dielectric constant.

Medium dielectric constant materials have a dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850° C. to 900° C. for the materials cited above).

The plurality of ceramic tape layers and stacked sub-stacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an optical microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized tunable dielectric and/or magnetic characteristics for improving the density and performance of circuits, including those including dipole-based antenna arrays, such as LPDAs. The dielectric flexibility allows independent optimization of the feed line impedance and the respective dipole antenna elements.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A log periodic dipole array (LPDA) antenna, comprising:

a dielectric circuit board substrate, said substrate having at least a first portion, said first portion providing a first relative permeability and a first relative permittivity, said first relative permeability and said first relative permittivity being different from a bulk portion of said substrate; and at least one feed line and a plurality of dipole elements electrically connected to said feed line, at least a portion of said dipole elements disposed on said first portion.

2. The antenna of claim 1, wherein said first relative permeability is from about 4 to 116.

3. The antenna of claim 1, wherein at least a portion of said feed line being disposed on a second portion of said substrate, said second portion providing at least one of a second relative permeability and a second relative permittivity different from said bulk portion of said substrate.

4. The antenna of claim 3, wherein said second relative permeability is from about 4 to 116.

5. The antenna of claim 1, wherein said feed line comprises a broadband impedance transformer comprising a plurality of segments.

6. The antenna of claim 5, wherein said plurality of segments have quarter wave electrical lengths, said respective electrical lengths determined at a highest frequency over which respective impedance transforms are to occur.

7. The antenna of claim 3, wherein at least one of said second relative permittivity and said second relative permeability vary along a length of said feed line.

8. The antenna of claim 7, wherein a characteristic impedance of said feed line varies along its length in accordance with a tapered line type transformer.

9. The antenna of claim 8, wherein said characteristic impedance of said feed line is at least partially determined by a gradation of at least one said second relative permittivity and said second relative permeability along a length of said feed line.

10. The antenna of claim 9, wherein said gradation continuously varies along at least a portion of said length of said feed line.

11. The antenna of claim 1, wherein said substrate comprises meta-materials.

12. The antenna of claim 1, wherein said first relative permeability is approximately equal to the square root of said first relative permittivity.

13. The antenna of claim 3, wherein said feed line has an electrical width that increases substantially logarithmically outward from at least one feedpoint of said LPDA.

14. The antenna of claim 13, wherein a physical width of said feed line increases in a non-substantially logarithmic manner.

15. The antenna of claim 1, wherein said substrate has a substantially uniform thickness, further comprising a substantially planar ground plane disposed beneath said substrate, wherein said LPDA is a planar array.

16. The antenna of claim 15, wherein a relative permittivity of said substrate beneath said feed line increases as said feed line moves out from a feed point of said LPDA.

17. The antenna of claim 16, wherein said relative permittivity increase is linearly graded.

18. The antenna of claim 16, wherein said relative permittivity increase is stepped.

19. A log periodic dipole array (LPDA) antenna, comprising:

a dielectric circuit board substrate, said substrate having at least a first portion, said first portion providing at least one of a first relative permeability and a first relative permittivity, said first relative permeability and said first relative permittivity being different from a bulk portion of said substrate; and at least one feed line and a plurality of dipole elements electrically connected to said feed line, at least a portion of said dipole elements disposed on said first portion;

wherein said first relative permeability is from about 4 to 116.

20. A log periodic dipole array (LPDA) antenna, comprising:

a dielectric circuit board substrate, said substrate having at least a first portion, said first portion providing at least one of a first relative permeability and a first relative permittivity, said first relative permeability and said first relative permittivity being different from a bulk portion of said substrate; and at least one feed line and a plurality of dipole elements electrically connected to said feed line, at least a portion of said dipole elements disposed on said first portion;

wherein at least a portion of said feed line is disposed on a second portion of said substrate, said second portion providing at least one of a second relative permeability and a second relative permittivity different from said bulk portion of said substrate and said second relative permeability is from about 4 to 116.

21. A log periodic dipole array (LFDA) antenna, comprising:

a dielectric circuit board substrate, said substrate having at least a first portion, said first portion providing at least one of a first relative permeability and a first relative permittivity, said first relative permeability and said first relative permittivity being different from a bulk portion of said substrate; and at least one feed line and a plurality of dipole elements electrically connected to said feed line, at least a portion of said dipole elements disposed on said first portion;

wherein said first relative permeability is approximately equal to the square root of said first relative permittivity.

* * * * *